US007398938B2

(12) United States Patent
Antensteiner

(10) Patent No.: US 7,398,938 B2
(45) Date of Patent: Jul. 15, 2008

(54) CONICAL REFINER PLATES WITH LOGARITHMIC SPIRAL TYPE BARS

(75) Inventor: Peter Antensteiner, Lewisburg, PA (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 11/330,561

(22) Filed: Jan. 11, 2006

(65) Prior Publication Data

US 2006/0113415 A1 Jun. 1, 2006

Related U.S. Application Data

(63) Continuation-in-part of application No. 10/476,779, filed as application No. PCT/US03/12417 on Apr. 22, 2003.

(60) Provisional application No. 60/659,921, filed on Mar. 8, 2005, provisional application No. 60/375,531, filed on Apr. 25, 2002.

(51) Int. Cl.
*B02C 7/04* (2006.01)
*B02C 7/06* (2006.01)
*B02C 13/20* (2006.01)

(52) U.S. Cl. ..... 241/261.2; 241/296

(58) Field of Classification Search ..... 241/261.2, 241/261.3, 296–298
See application file for complete search history.

(56) References Cited

U.S. PATENT DOCUMENTS

| | | | | |
|---|---|---|---|---|
| 3,589,630 | A * | 6/1971 | Danforth et al. | 241/261.1 |
| 4,023,737 | A * | 5/1977 | Leider et al. | 241/261.3 |
| 4,874,136 | A * | 10/1989 | Webster | 241/251 |
| 5,354,005 | A | 10/1994 | Mladota | |
| 5,425,508 | A * | 6/1995 | Chaney | 241/261.2 |
| 5,893,525 | A * | 4/1999 | Gingras | 241/298 |
| 6,042,036 | A * | 3/2000 | Virving et al. | 241/261.3 |
| 6,276,622 | B1 * | 8/2001 | Obitz | 241/261.3 |
| 6,325,308 | B1 * | 12/2001 | Lofgren et al. | 241/28 |
| 6,418,927 | B1 * | 7/2002 | Kullik | 128/204.18 |
| 6,607,153 | B1 * | 8/2003 | Gingras | 241/298 |
| 2002/0050066 | A1 * | 5/2002 | Krauss | 30/376 |
| 2005/0161542 | A1 * | 7/2005 | Theut | 241/298 |

* cited by examiner

*Primary Examiner*—Bena Miller
(74) *Attorney, Agent, or Firm*—Alix, Yale & Ritas, LLP

(57) ABSTRACT

A special shape of bars on refining cones or plate segments of a rotating conical refiner is disclosed including a plurality of bars generally extending outwards towards the outer end of the cone across its working surface, arranged in a single, two or more radial zones, the plurality of the bars within a zone being curved with the shape of a logarithmic type spiral. Conical refiners including such refining cones are also disclosed.

7 Claims, 12 Drawing Sheets

CONICAL REFINER PLATES WITH LOGARITHMIC SPIRAL TYPE BARS

RELATED APPLICATION

This application claims the benefit under 35 U.S.C. §119 (e), of the filing date of U.S. Provisional Application No. 60/659,921 filed Mar. 8, 2005, for "Conical Refiner Plates with Logarithmic Spiral Type Bars", and under 35 U.S.C. §120 as a continuation-in-part of U.S. application Ser. No. 10/476,779 filed Nov. 5, 2003 as the national phase of International Application PCT/US03/12417 filed Apr. 22, 2003, which claims the benefit of the filing date of U.S. Provisional Application No. 60/375,531 filed Apr. 25, 2002 under 35 U.S.C. §119(e).

BACKGROUND OF THE INVENTION

The present invention relates to refining cones and plate segments for refining cones, and more particularly to the shape of the bars that define the refining elements of the cones or conical segments.

Disc or conical refiners for lignocellulosic material, ranging from saw dust to wood chips, are fitted with refining plates or segments. The material to be refined is treated in a gap defined between two refining cones rotating relative to each other. The material moves in the grooves formed between bars located on the conical surfaces, providing a transport function and a mechanism for material stapling on the leading edges of the crossing bars. The instantaneous overlap between the bars located on each of the two cone faces forms the instantaneous crossing angle. The crossing angle has a vital influence on the material stapling or covering capability of the leading edges.

Conventional bar geometries, particularly parallel straight line, radial straight line, and curved in the form of inviolate arcs on circular evolutes, as well as projections thereof from planar reference surfaces onto conical surfaces, show a change of bar crossing angle with respect to radial position within refining zones. Parallel straight-line patterns show furthermore a change of bar angle with respect to peripheral position within a field of parallel bars.

Since bar crossing angle is a determining factor for covering probability, a variation in bar angle leads to a variation in covering probability as well. Therefore an inhomogeneous distribution of material in the gap as a function of radial and angular position is unavoidable by conventional bar designs. Representative patents directed to particular configurations of bars and grooves on segments for refiner plates, include: U.S. Pat. No. 6,276,622 (Obitz), "Refining Disc For Disc Refiners", Aug. 21, 2001; U.S. Pat. No. 4,023,737 (Leider et al.), "Spiral Groove Pattern Refiner Plates", May 17, 1977; and U.S. Pat. No. 3,674,217 (Reinhall), "Pulp Fiberizing Grinding Plate", Jul. 4, 1972.

SUMMARY OF THE INVENTION

In order to provide a uniform covering along the length of the bars independent of radial or angular position, the bars should be shaped in a form that provides constant bar crossing angle regardless of position.

Accordingly, the object of the present invention is to provide a refining element bar shape with the desired feature of constant bar and thus constant crossing angle to promote a more homogeneous refining action.

A conical refiner plate and associated segments wherein the bars assume the shape of a logarithmic spiral or projected logarithmic spiral, satisfy the foregoing object of the invention. As used herein, "logarithmic type spiral" should be understood as consisting of a logarithmic spiral in two dimensions or such logarithmic spiral projected in three dimensions.

The invention can in one aspect be characterized as a refining cone having a working surface, a radially inner edge and a radially outer edge, the working surface including a plurality of bars laterally spaced by intervening grooves and extending generally outwardly toward the outer edge across the surface, wherein the bars are curved with the shape of a logarithmic type spiral.

From another aspect, the invention can be characterized as a conical refiner including first and second opposed, relatively rotatable refining cones which define a refining space or gap, the first and second cones each having a plate with a radially inner edge, a radially outer edge, and a working surface including a plurality of bars generally extending outwardly toward the outer edge across the surface, wherein the plurality of bars on at least the first cone are curved with the shape of a logarithmic type spiral.

During operation of the refiner, each of the bars on the first cone will be crossed in the refining space by a plurality of bars on the second cone, thereby forming instantaneous crossing angles. For each of the bars on the first cone, the crossing angle is a substantially constant nominal angle. Preferably for each of the plurality of bars on the first cone, all instantaneous crossing angles are within +/−5 degrees of the nominal crossing angle.

An additional feature of the logarithmic type spiral is the variability of groove width, i.e., the distance between adjacent bars with respect to radial position. The grooves increasingly open in the direction of stock flow, which prevents plugging of the grooves with fibers and tramp material.

DESCRIPTION OF THE PREFERRED EMBODIMENT

The present invention will be described with reference to my prior invention directed to refiner plates having bar and groove patterns in the shapes of a logarithmic spirals, as disclosed in U.S. Patent Publication No. US2004/0149844, the disclosure of which is hereby incorporated by reference. In essence, the common inventive concept is the constant bar angle and thus constant bar crossing angle independent of the angular position or position traversing at least one zone along a line from the inner toward the outer edge of the face of the plate. The bars on the flat disc plate actually follow the curves defined by the mathematical expression for a logarithmic spiral, whereas for a conical plate, the bars do not necessarily follow a true logarithmic spiral but are derived from a true logarithmic spiral.

For the conical plates, a logarithmic spiral pattern is first defined in a planar surface (on an imaginary X-Y plane), and then this logarithmic spiral is projected onto a three-dimensional surface in X-Y-Z space. Bars formed according to the former are true logarithmic spirals, whereas bars formed according to the latter are distortions of true logarithmic spirals, but can nevertheless be referred to as "logarithmic type spiral" bars. They are not only derived from true logarithmic spirals, but also preserve in X-Y-Z space, the constant bar angle and the constant bar crossing angle.

For a better understanding of the conical plates, the logarithmic spiral for disc plates will first be described.

Figure 1:
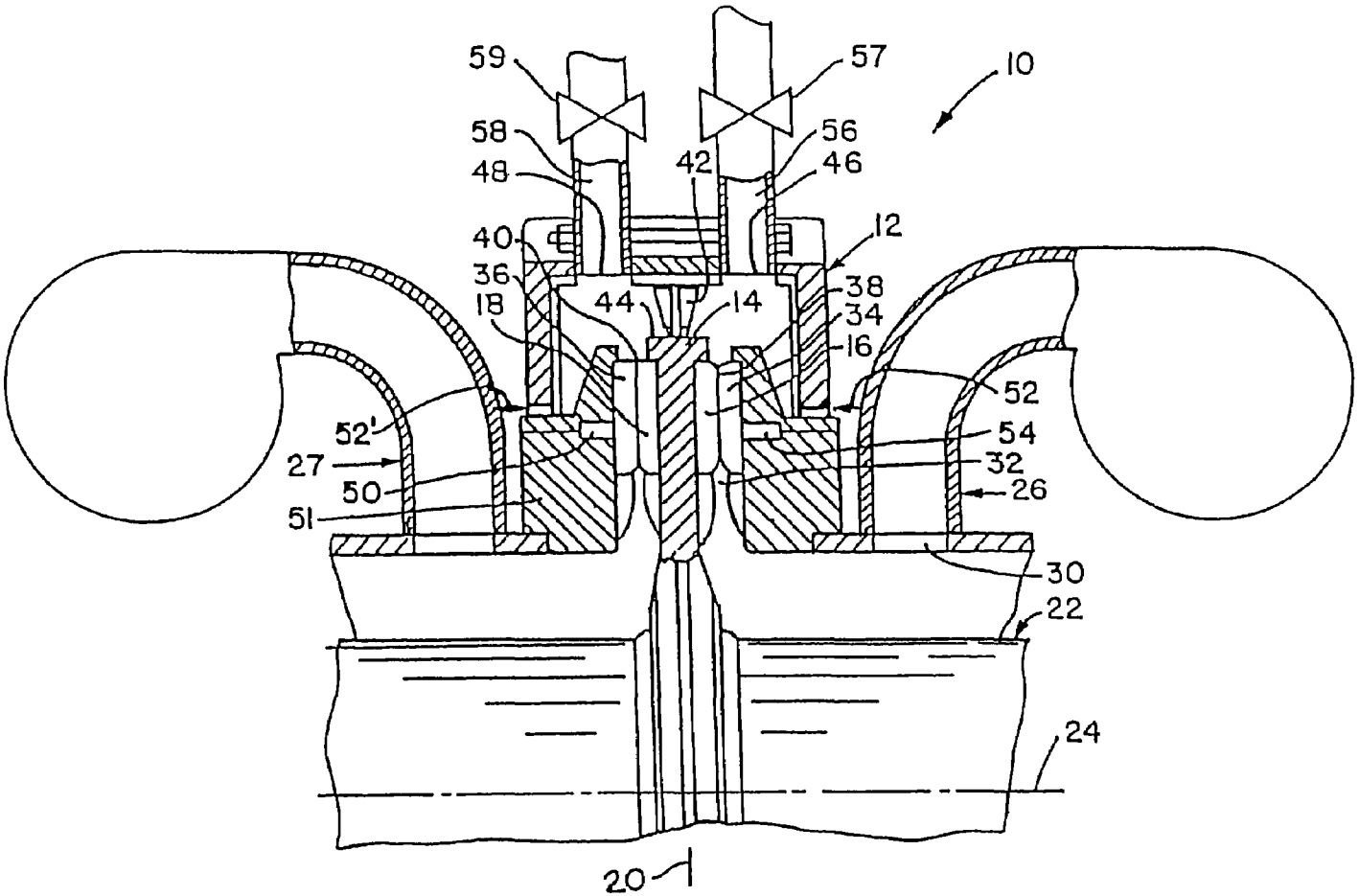
FIG. 1 is a schematic of an internal portion of flat disc wood chip refiner, illustrating the relationship of opposed, relatively rotating discs, each of which carries an annular plate consisting of a plurality of plate segments.

FIG. 1 is a schematic showing a flat disc refiner 10 with casing 12 in which opposed discs are supported, each of which carries an annular plate or circle consisting of a plurality of plate segments. The casing 12 has a substantially flat rotor 14 situated therein, the rotor carrying a first annular plate defining a first grinding face 16 and a second annular plate defining a second grinding face 18. The rotor 14 is substantially parallel to and symmetric on either side of, a vertical plane indicated at 20. A shaft 22 extends horizontally about a rotation axis 24 and is driven at one or both ends (not shown) in a conventional manner.

A feed conduit 26 delivers a pumped slurry of lignocellulosic feed material through inlet opening 30 on either side of the casing 12. At the rotor, the material is re-directed radially outward through the coarse breaker region 32 whereupon it moves along the first grinding face 16 and a third grinding face 34 juxtaposed to the first face so as to define a right side refining zone 38 therebetween. Similarly, on the left side of the rotor 14, material passes through the left refining zone 40 formed between the second grinding face 18 and the juxtaposed grinding face 36.

A divider member 42 extends from the casing 12 to the periphery, i.e., circumference 44, of rotor 14, thereby maintaining separation between the refined fibers emerging from the refining zone 38, relative to the refined fibers emerging from the refining zone 40. The fibers from the right refining zone are discharged from the casing through the discharge opening 46, along discharge stream or line 56, whereas the fibers from the left refining zone 40 are discharged from the casing through opening 48 along discharge line 58.

Thus material to be refined is introduced near the center of a disc, such that the material is induced to flow radially outwardly in the space between the opposed refining plates, where the material is influenced by the succession of groove and bar structures, at a "beat frequency", which is dependent on the dimensions of the grooves and the bars, as well as the relative speed of disc rotation. The material tends to moves radially outward, but the shape of the bars and grooves is intentionally designed to produce a stapling effect and a retarding effect whereby the material is retained in the refining zone between the plates for an optimized retention time.

Although the gap between plates where refining action occurs is commonly referred to as the "refining zone", the opposed plates often have two or more distinct bar and groove patterns that differ at radially inner, middle, and outer regions of the plate; these are often referred to as inner, middle, and outer "zones" as well.

In accordance with the underlying concept of the present invention, the further variable of the bar-crossing angle is maintained substantially constant. This is accomplished by the bars substantially conforming in curvature to the mathematical expressions for a logarithmic spiral. In particular, during operation of the refiner each of the bars on the first disc will be crossed in the refining space by a plurality of bars on the second disc, thereby forming instantaneous crossing angles, and for each of the bars on the first disc, the crossing angle is a substantially constant nominal angle.

Figure 2:
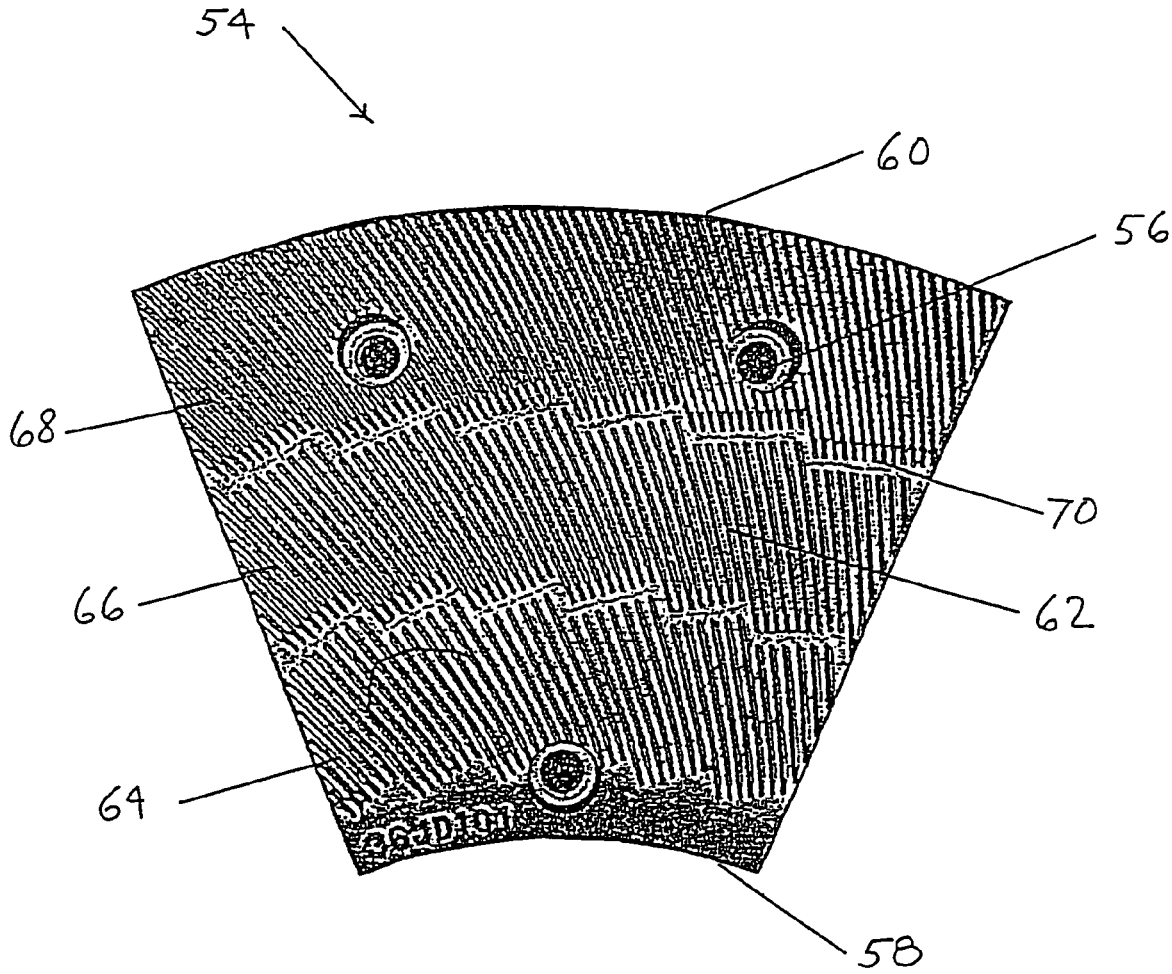
FIG. 2 is a photograph of a disc refiner plate segment incorporating refiner bars in the shape of logarithmic spirals.

With reference to FIG. 2, there is shown a refining segment 54, which is disposed on the inside of a refining disc and which is intended for coaction with the same or different kind of refining segments on an adjacent refining disc on the other side of the refining gap. Several segments as shown in FIG. 2 are typically secured side-by-side to a base (e.g., rotor or stator) to form a substantially circular (e.g., circular or annular) refining plate. The segment has the general shape of a truncated sector of a circle. Each segment may be mounted to the plate holder surface of the base by means of machine screws inserted through countered bolt holes 56. Some refiner designs may allow fastening the plates from the back, which eliminates the boltholes from the face of the plate. In general segments are mounted on discs rotating relative to each other, which could be achieved by the presence of one rotor and one stator (single disc refiner), or by one rotor segmented on both sides and operating against two stators (double disc refiner), or by several rotors working against each other and a pair of stators (multi disc refiner), or by counter-rotating discs.

Each refining disc segment can be considered as having a radially inner end 58, a radially outer end 60, and a working surface therebetween, the working surface including a plurality of bars 62 laterally spaced by intervening grooves and extending generally outwardly toward the outer end across the surface. Preferably all, but at least most, of the bars are curved with the shape of a logarithmic spiral.

As is common for both low and high consistency refining of wood chip or second stage material, the bars on a plate formed by the segments of FIG. 2 are arranged in three radially distinct refining zones 64, 66, 68, between the inner and outer plate edges 58, 60. A Z-shaped transition zone 70 accomplishes the material flow transition between the individual refining zones. In this embodiment, the bars in each zone follow a logarithmic spiral. The particular shape parameter (alpha) may be different for each zone, but the shape parameter for each confronting zone on the opposed plate, would preferably be the same.

This particular and unique shape provides the advantage of the independence of bar angle from the location of the bar on the plate in a particular refining zone. Since the particular shape of the logarithmic spiral guarantees the bar intersecting angle with lines through the center of the plate to be constant, no bar angle and therefore crossing angle variation in the course of the relative movement of rotor and stator segments occurs. Since bar angle has a significant impact on refining action and bar covering probability, any variation of bar and crossing angle will result in a variation of refining action. The invention achieves maximum homogeneity of refining action by minimizing bar angle variation.

The width of the groove between two adjacent logarithmic spiral bars is variable and increases with radial distance by the nature of the curve.

Thus the groove width at the ID of zone 68 is smaller than on the OD of the zone, the OD of the outer edge 60 of the plate in this case. Therefore the open area available for stock flow increases disproportional with increasing radius. This feature provides increased resistance against plugging in comparison to parallel bar designs, where no groove width variation occurs.

Figure 3:
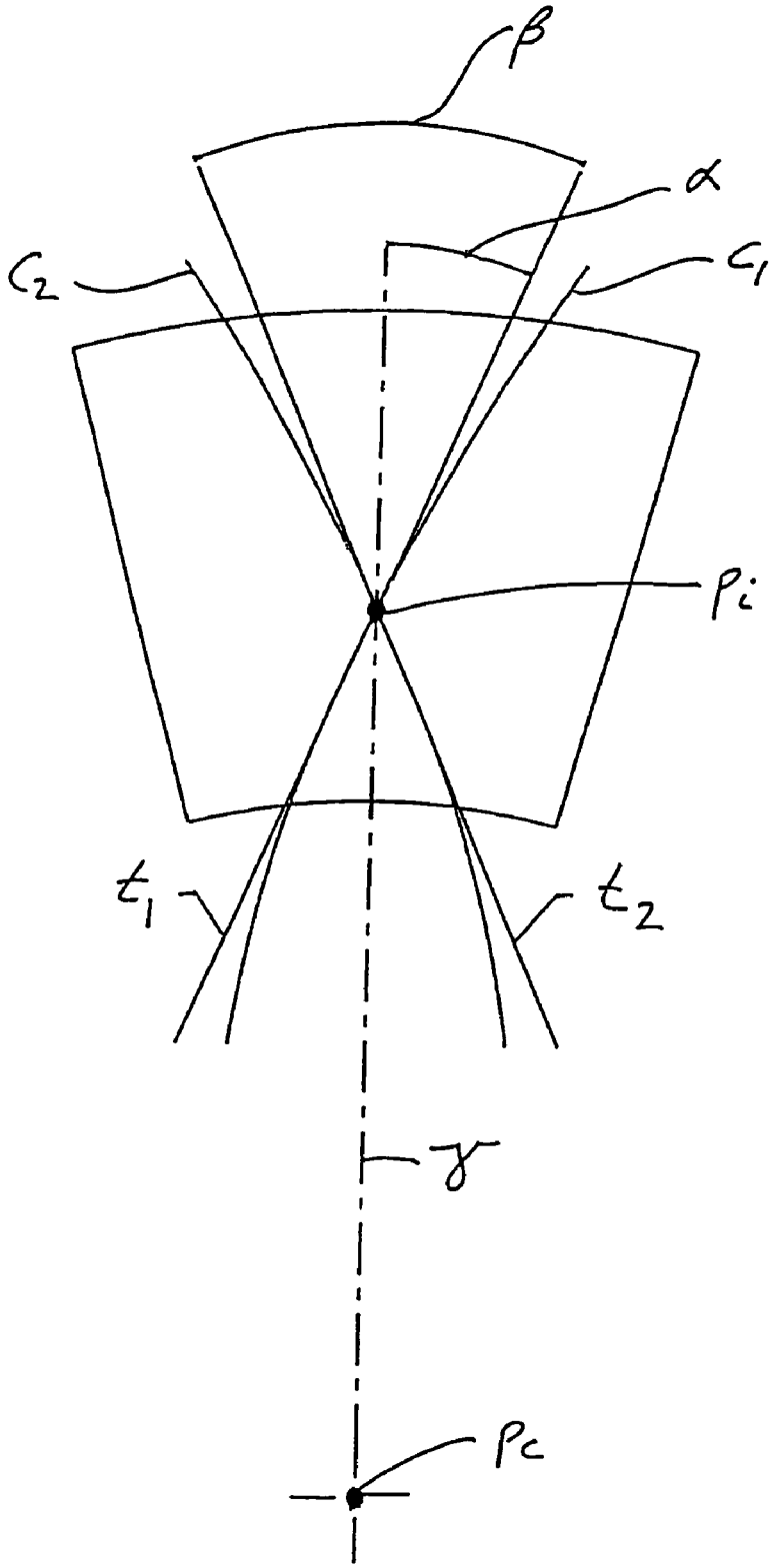
FIG. 3 is a schematic by which the mathematical representation of a logarithmic spiral on a disc plate can more easily be understood.

With reference to FIG. 3, the crossing angle $\beta$ appears as the intersecting angle between the tangents $t_1$ and $t_2$ to the two curves $c_1$ and $c_2$ (i.e., the curved leading edges of crossing bars) at the point of intersection $p_i$. The angle $\beta$ between the tangents remains constant, at every possible crossing point. Each bar has an angle $\propto$ relative to the generatrix $\gamma$ passing through the center point $p_c$.

Figure 4:
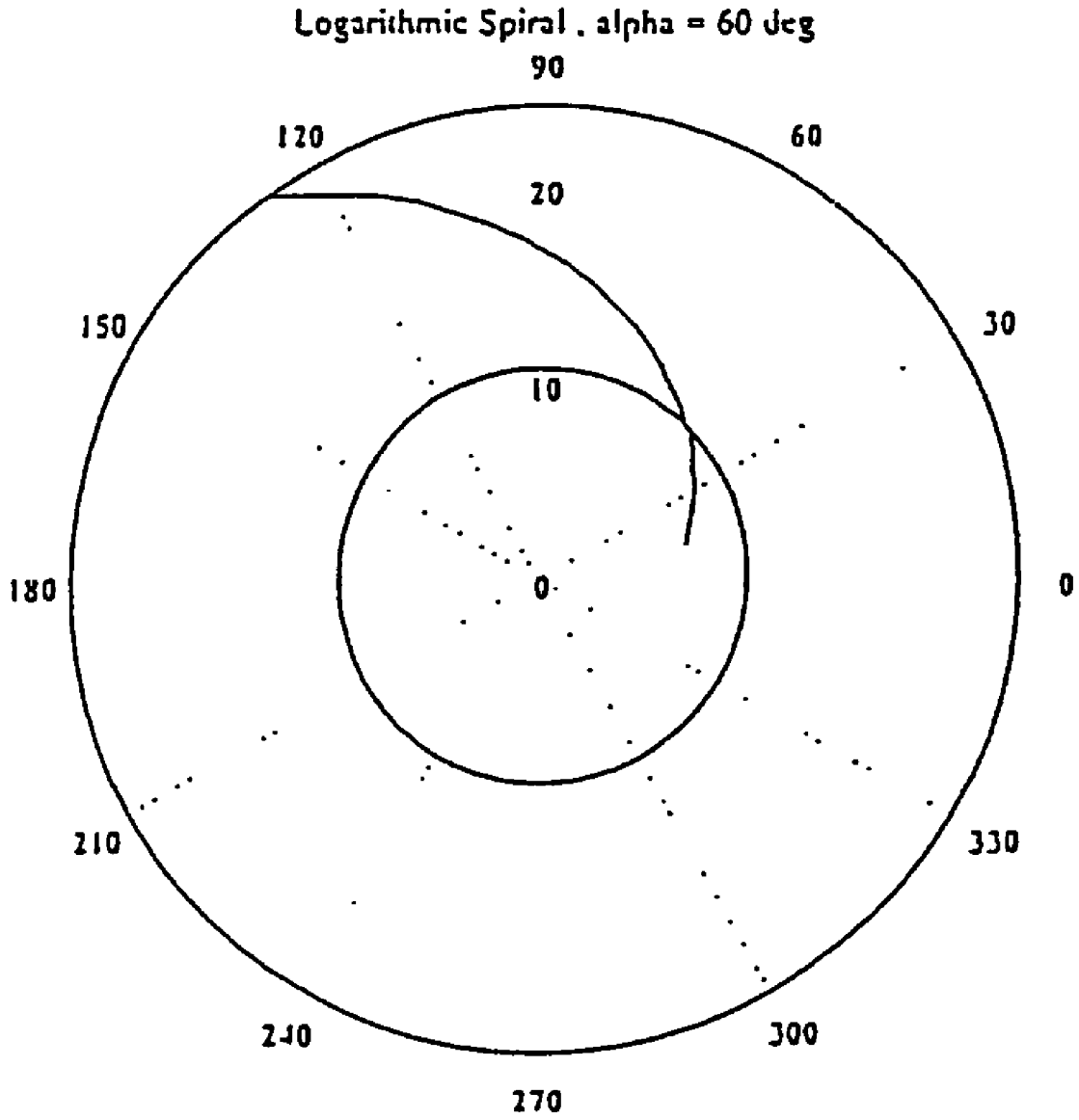
FIG. 4 is a schematic representation of a flat disc bar curvature for the value alpha=60 deg.
Figure 5:
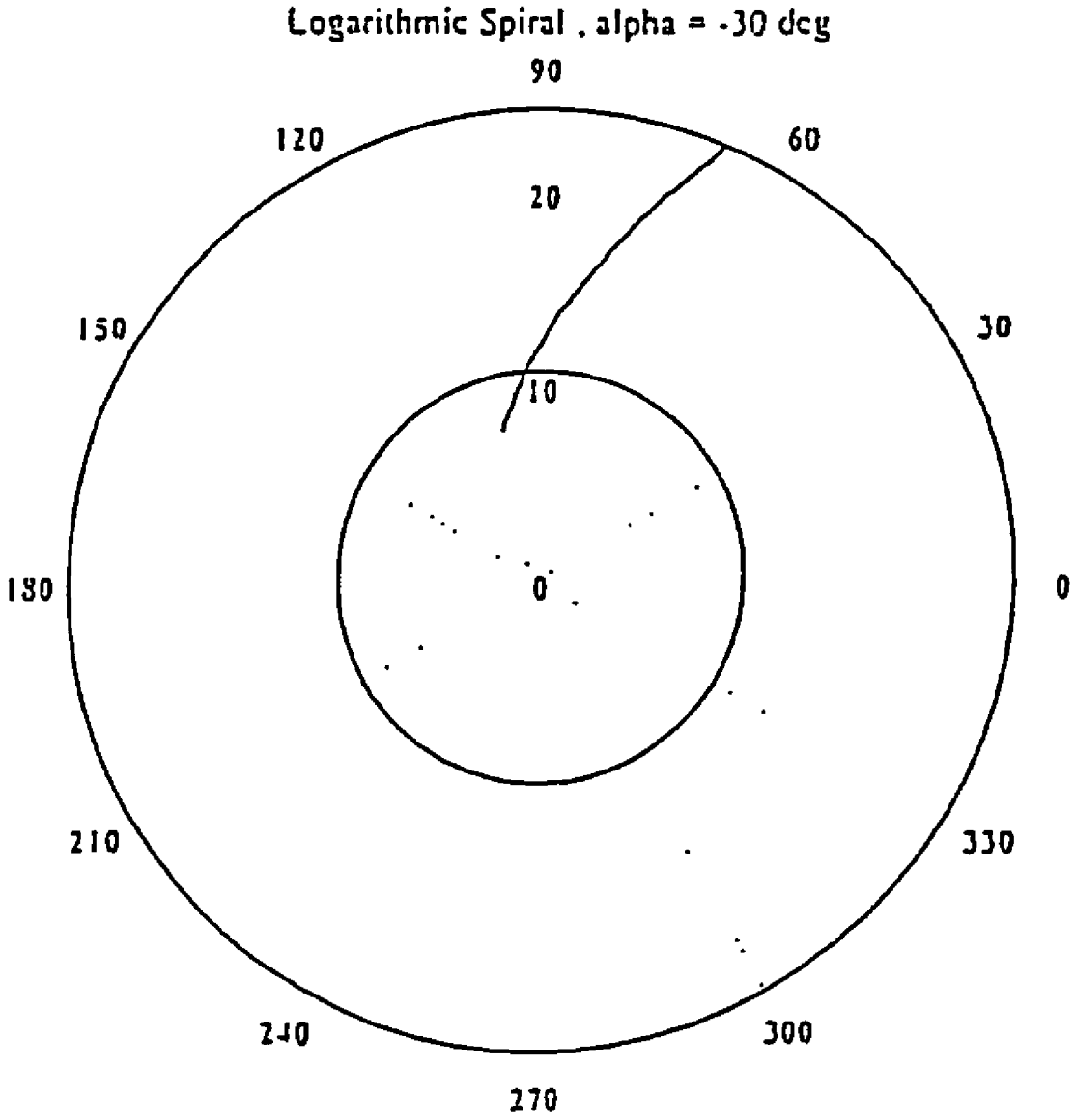
FIG. 5 is a schematic representation of a flat disc bar curvature for the value alpha=−30 deg.

FIGS. 4 and 5 are schematic representations of the bar curvature for two different values of alpha. FIG. 4 shows the curvature for alpha=60 degrees, and FIG. 5 shows the curvature for alpha=−30 degrees. The designer has the flexibility to select the angle between plus 90 degrees and minus 90 degrees.

The mathematical expression for the shape of the logarithmic spiral bar, defines any given bar which in the limit, is a line of infinitesimal thickness such that the location of any given point on the line is a function of the angular position (phi) of the point relative to a reference radius or diameter through the center (along the generatrix of the coordinate system) and the intersecting angle (alpha) between the tangent to the curvature of the bar at the point, and the generatrix. This mathematical relationship is used in a practical sense, to design functional bar patterns.

This would typically be performed in a computer assisted design (CAD) system which is readily programmed to incorporate the mathematical model and which has an output that can translate the mathematical modeling of the segment, to equipment for producing a tangible counterpart from a segment blank. This would proceed by having one spiral curve calculated in radial increments, thereby establishing the "mother" of all the other bars, by determining the starting radius as well as the starting angle (arrived at by adding a constant to the calculation result). The one full curve (representing the leading edge of the "mother" bar) will be located somewhere on the segment. In a CAD system, the curve will not necessarily be a mathematically continuous, full logarithmic spiral but rather can be approximated by a spline fit. The accuracy of the spline depends on the radial increments selected. Moreover, the first few points on the spline, close to the inside diameter of the segment, may not match closely to the theoretically logarithmic spiral, but this artifact of the CAD system has little adverse consequence if limited to the small radius at the inside diameter. The typical CAD system (e.g., AutoCad®) then allows the user to offset the trailing edge of the mother bar, thereby giving the bar a selected width which is established from the inner to the outer radius of the segment. The mother bar can then be copied and rotated to fill the segment. For example, the user can specify the bar width at a given radius, the number of bars for the segment, or the minimum desired groove width at a given radius, etc.

It should be appreciated that, in view of modern manufacturing techniques, the term "logarithmic spiral" as used herein, although based on a mathematical expression, may in practice only approximate the mathematical expression through a series of straight or curved lines each of which is relatively short as compared with the full length of the curve from the inner to the outer radius of the segment, or from the inner radius to the outer radius of a given zone in the segment. Similarly, a reasonable degree of latitude should be afforded the inventor in reading the term "logarithmic spiral" on the shape of curved bars according to which one of ordinary skill in the relevant field of endeavor would recognize an attempt to maintain conservation of the bar crossing angle in the radial direction on a given segment, or within the zone of a given segment. The benefit of the present invention can be realized to a significant extent relative to the prior art, even if the logarithmic spiral is merely approximated, e.g., if the crossing angle is maintained within +/−10 degrees from the radially inner end to the radially outer end of a given bar.

Variations of the invention can be readily understood without reference to other drawings. For example, in the context of the invention as implemented in a refiner, a first refining disc faces a second relatively rotatable refining disc with a refining space there between. Either both or only one of the first and second discs has a shape and surface with an inner end and an outer end including a plurality of bars generally extending outwardly toward the outer end across the surface, with the plurality of bars being curved with the shape of a logarithmic spiral. If both discs have segments with curved bars following the same logarithmic spiral, constant bar crossing angles will be achieved. If the facing discs both have logarithmic spiral bar curvature, but with different parameters alpha, some design variability for specialty purposes can be achieved. If only one disc has a logarithmic spiral bar curvature, and the facing disc has a conventional bar pattern, the result will still advantageously reduce bar crossing angle variation relative to two facing discs having the same such conventional pattern.

Figure 6:
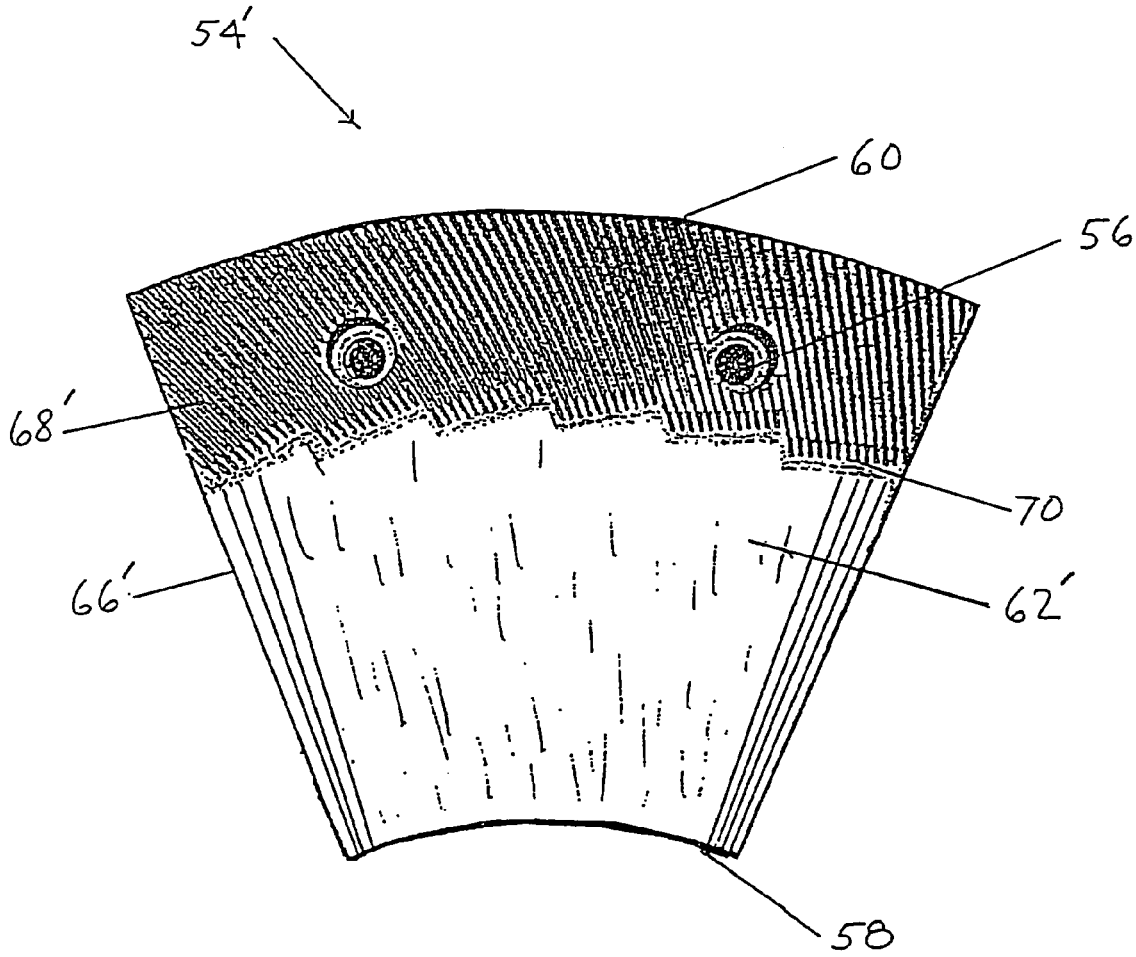
FIG. 6 is a schematic plan view similar to FIG. 2, showing an embodiment wherein only the outer of a plurality of refining zones has bars in a logarithmic spiral pattern.

In another embodiment the logarithmic spiral bar curvature is present in fewer than all the radial zones. FIG. 6 is a schematic plan view similar to FIG. 2, showing an embodiment of a segment 54' wherein only the outer 68' of a plurality of refining zones on working surface 62' has bars in a logarithmic spiral pattern. In a two or three zone plate, the radially outermost zone would preferentially have the logarithmic spiral bars, because the number of fiber treatments increases with disc radius according the third power of the radius. In such case, the inner zone(s) 66' would preferably follow the so-called "constant angle" pattern, as exemplified in the 079/080 pattern available from Durametal Corp. for the Andritz Twin-Flo refiner and shown only schematically in FIG. 6.

Figure 7:
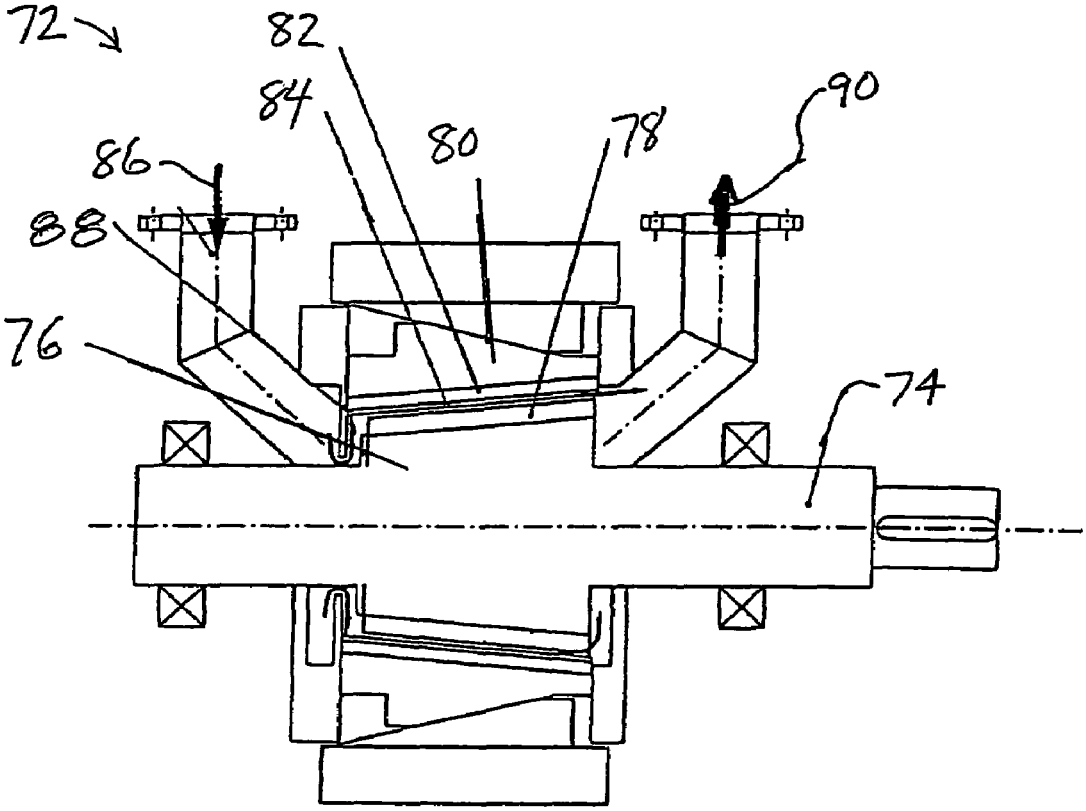
FIG. 7 is schematic of a conical refiner having inner and outer conical plates defining an annular refining gap through which material flows in the direction from the smaller diameter to the larger diameter.

FIGS. 7-11 show how the previously described concept is implemented in a conical refiner. FIG. 7 shows a conical refiner 72 with a rotating shaft 74 carrying rotor 76 with associated conical plate 78 and stator 80 with associated conical plate 82 thereby defining the refining gap 84 therebetween. Feed material enters at feed conduit 86, passes into the refining gap at 88 and is discharged through discharge conduit 90.

The invention may be described mathematically.

(1): Construction of a Logarithmic Spiral on a Flat Reference Surface

Using polar coordinates r and $\phi$, the following transformation function to Cartesian coordinates would apply:

$$x=r\cdot\cos\phi$$

$$y=r\cdot\sin\phi$$

$$r^2=x^2+y^2$$

The general shape of the logarithmic spiral bar is represented by $$r=a\cdot e^{k\cdot\phi}$$

$$k=\cot\alpha$$

$$k=0\rightarrow\text{circle}$$

where "a" is a scale parameter for r and α (alpha) is the intersecting angle between any tangent to the curve and a line through the center (generatrix) of the coordinate system.

In the case of alpha=90 deg or −90 deg, the tangent of the curve in any point would be orthogonal to the generatrix, and the curve is therefore a circle with radius a.

This unique bar shape provides not only identity for individual bar angles but also the so-called cutting or crossing angle assumes the same identity throughout the whole refining zone.

(2): Projecting the Logarithmic Spiral from a Plane Orthogonal to the Cones Axis onto the Conical Surfaces The described logarithmic spiral is well-defined for the x-y plane. This invention utilizes the constant angle nature of this special curve and projects it from a plane orthogonal to the axis of the cone on its surface.

In this process the curve assumes a three-dimensional form in the x-y-z continuum. The inclination and curvature of the conical surface makes the length of the projection differ from the original in the x-y plane. This leads to a change in the value of bar/crossing angles, bar widths, groove widths and edge lengths from the original values in the x-y plane. Nevertheless, the constant angle nature of the curve with respect to the cone's generatrix remains preserved in this process. This is the basis for the term logarithmic type spiral.

The transformation functions for the spiral angles are $$\alpha := \operatorname{atan}\left(\frac{\tan\left(\alpha cone\cdot\frac{\pi}{180}\right)}{\sin\left(20\cdot\frac{\pi}{180}\right)}\right)\cdot\frac{180}{\pi}$$

In this formula half of the cone angle to its axis is set to 20 degrees (appears in the sines part). Any cone angle deviation would show up there. The variable αcone means the bar angle target for the logarithmic spiral type curve on the cone, while α nominates the logarithmic spiral bar angle target in the original x-y plane.

The lengths involved in this transformation develop according to the following formula:

$$bw := \frac{bwcone}{\sqrt{\sin\left[(90-\alpha cone)\cdot\frac{\pi}{180}\right]^2+\frac{\cos\left[(90-\alpha cone)\cdot\frac{\pi}{180}\right]^2}{\sin\left(20\cdot\frac{\pi}{180}\right)^2}}}$$

-continued $$gw1 := \frac{gw1cone}{\sqrt{\sin\left[(90-\alpha cone)\cdot\frac{\pi}{180}\right]^2+\frac{\cos\left[(90-\alpha cone)\cdot\frac{\pi}{180}\right]^2}{\sin\left(20\cdot\frac{\pi}{180}\right)^2}}}$$

As above, the cone angle was assumed to be 20 degrees, appearing in the sines formula. The bwcone nominates the barwidth to be achieved on the cone after projection, while bw gives the bar width target for the logarithmic spiral in the x-y plane. The same rationale pertains to gw1cone and gw1.

Figure 8:
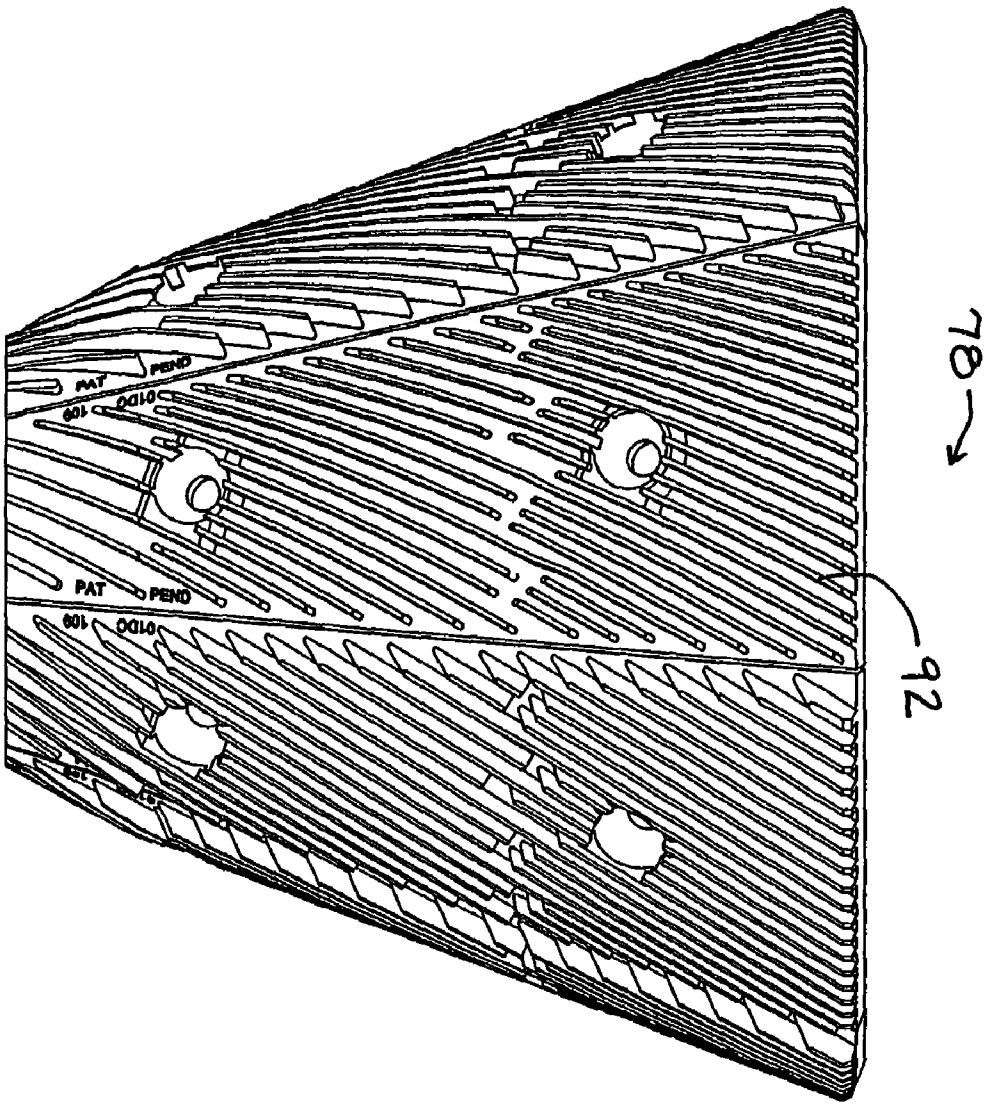
FIG. 8 is an elevation view of the inner, rotor cone of a three-zone conical refiner showing the conical refining plate resting with the smaller diameter edge on a horizontal surface and the rotation axis extending vertically.
Figure 9:
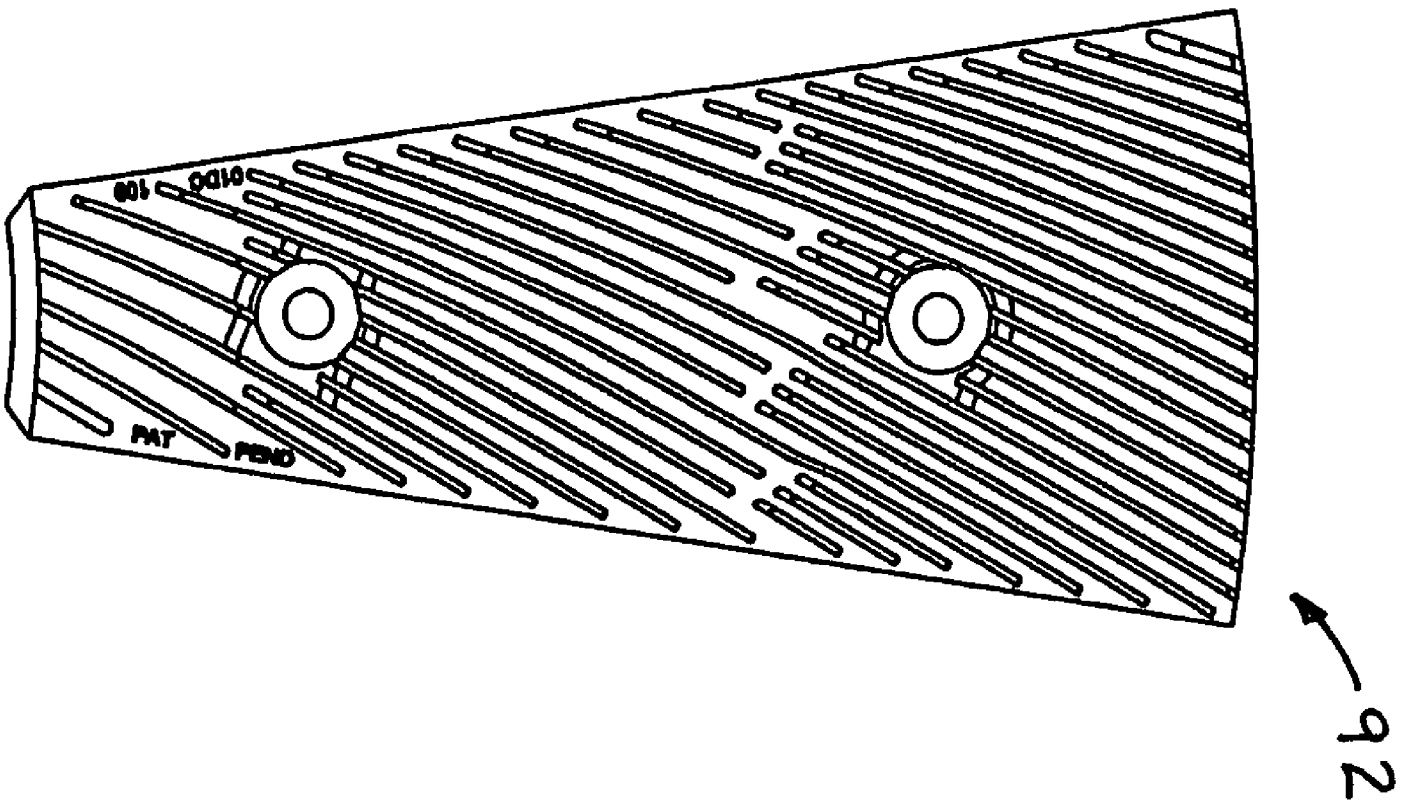
FIG. 9 is a plan view of an individual plate segment from among the plurality of segments that constitute the conical plate of FIG. 8.
Figure 10:
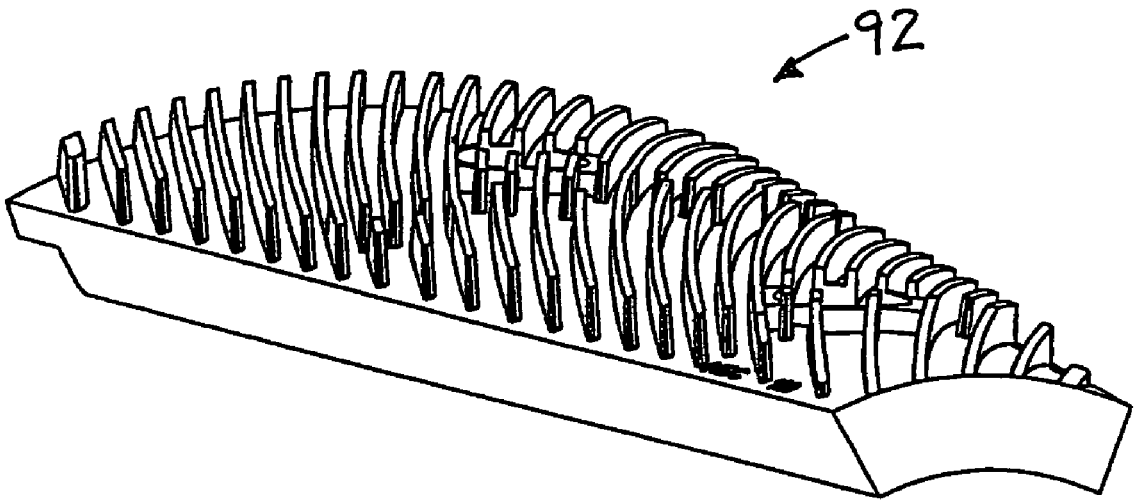
FIG. 10 is a perspective view of the plate segment of FIG. 9.
Figure 11A:
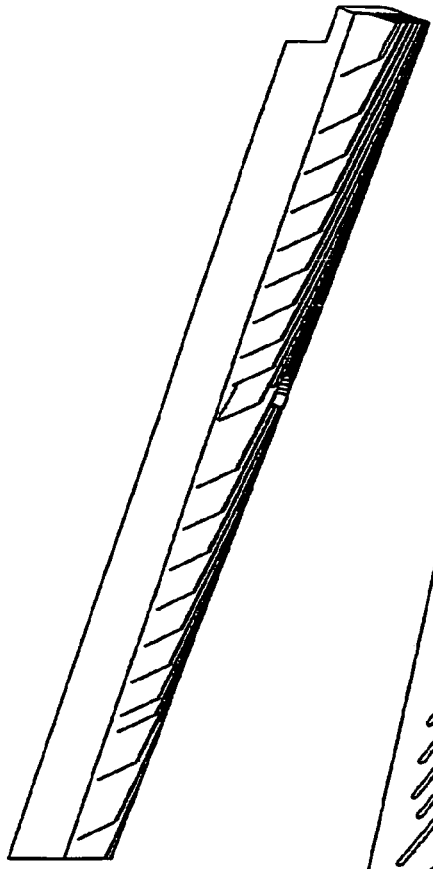
FIGS. 11A and 11B represent a group of bars defined by the mathematical expression in the first step of the present method.
Figure 11B:
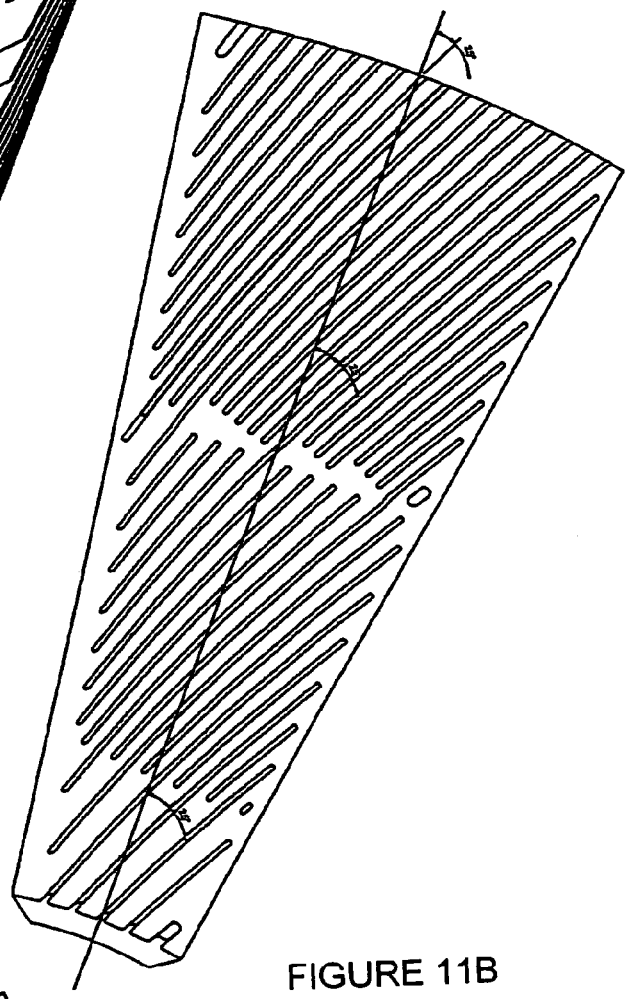
Figure 11C:
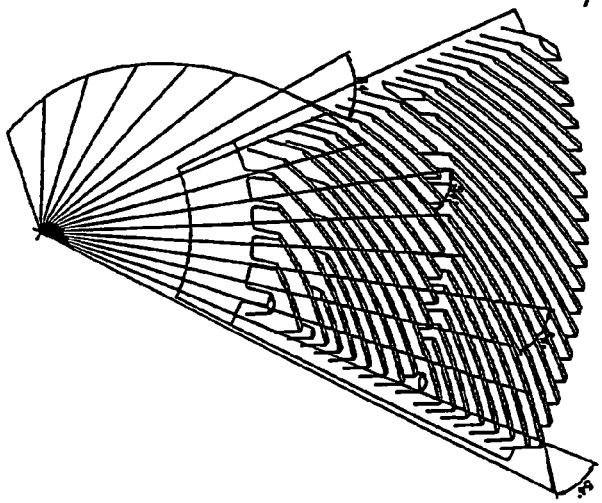
FIGS. 11C and 11D represent how the same group of bars would project onto a three dimension (X-Y-Z) conical surface when viewed perpendicularly to the surface to produce a bar pattern such as shown in FIG. 9.
Figure 11D:
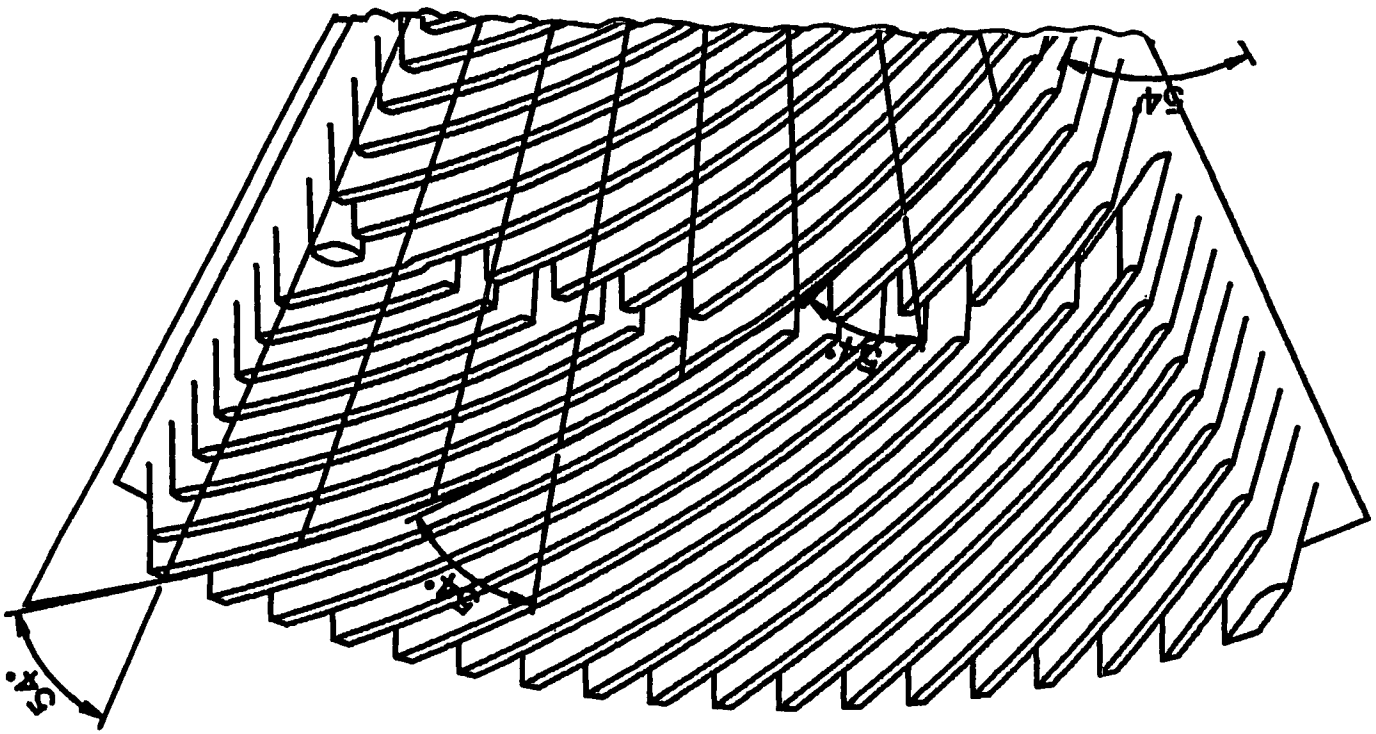

FIGS. 8-10 show a detailed view of one embodiment of a conical plate 78 and associated segment 92. FIGS. 11A-D show the generating logarithmic spiral in the X-Y plane superimposed on an X-Y plane projection of the refiner plate segment. In this case, the constant angle is 54 degrees. This angle changes as it is projected onto the conical surface (to 25 degrees) but the new angle remains constant on the conical surface with respect to a ray on that conical surface.

The invention includes a method for manufacturing a set of opposed plates including the steps of forming a pattern of bars and grooves that substantially conform to the foregoing mathematical expressions. As shown in FIG. 7, the conical inner plate 78 associated with rotor 76 has the bar and groove pattern around the convex outer surface. One embodiment of the plate and associated segments is shown in FIGS. 8-10. It can be readily understood that the confronting, outer conical plate 82 attached to the stator 80 would have a complimentary, concave inner curvature. Thus, in the manufacture of a set of plates for a conical refiner, one collection of segments having a convex outer surface would be selected and coordinated for arrangement side by side to form a first, inner conical plate, and another plurality of concave segments would be selected and coordinated for arrangement side by side to form a second, outer conical plate, the plates thus associated as a set for confronting installation in a conical refiner.

Although the invention herein has been described with reference to a particular, preferred embodiment, it is to be understood that these embodiments are merely illustrative of the principles and applications of the present invention. It is therefore to be understood that numerous modifications can be made to the illustrative embodiments and that other arrangements may be devised without departing from the spirit and the scope of the present invention.

What is claimed is:

1. A refining cone having a working surface, a radially inner end and a radially outer end, the working surface including a plurality of bars having inner and outer ends, laterally spaced by intervening grooves and extending generally outwardly toward said outer end across said conical surface, said plurality of bars being curved with the shape of a logarithmic type spiral from the inner to the outer ends of the bars, wherein the shape of said bars conforms within manufacturing tolerances to the mathematical expression in polar coordinates in an original x-y plane orthogonal to the cone axis:

$$r=a\cdot e^{k\cdot\phi}$$

where $$k=\cot\alpha$$

and $$k=0\rightarrow\text{circle}$$

this curve projected onto the working surface has a shape change according to the following formulae:

$$\alpha := \operatorname{atan}\left(\frac{\tan\left(\alpha cone \cdot \frac{\pi}{180}\right)}{\sin\left(20 \cdot \frac{\pi}{180}\right)}\right) \cdot \frac{180}{\pi}$$

$$bw := \frac{bwcone}{\sqrt{\sin\left[(90 - \alpha cone) \cdot \frac{\pi}{180}\right]^2 + \frac{\cos\left[(90 - \alpha cone) \cdot \frac{\pi}{180}\right]^2}{\sin\left(20 \cdot \frac{\pi}{180}\right)^2}}}$$

$$gw1 := \frac{gw1cone}{\sqrt{\sin\left[(90 - \alpha cone) \cdot \frac{\pi}{180}\right]^2 + \frac{\cos\left[(90 - \alpha cone) \cdot \frac{\pi}{180}\right]^2}{\sin\left(20 \cdot \frac{\pi}{180}\right)^2}}}$$

where "r" is the radial position along the centerline of the bar, "a" is a scale parameter for r and αis the intersecting angle between any tangent to the curve and the generatrix of the coordinate system, Gw1 cone and bwcone are bar and groove width on the cone, gw and bw the bars and grooves width in the original x-y plane, the angle acone denominates the angle of the logarithmic type spiral curve on the working surface between a tangent to the curve and the generatrix of the cone, and, a is the angle of the logarithmic spiral in the x-y-plane.

2. The refining cone of claim 1, wherein the plurality of bars includes the majority of bars on the working surface.

3. The refining cone of claim 1, wherein the cone has a pattern of bars and grooves arranged in at least two radially distinct zones, and essentially all the bars in the outermost zone are curved with said shape of a logarithmic type spiral.

4. The refining cone of claim 1, wherein the cone is formed by a substantially conical base and a refining plate attached to the base, the plate formed by a plurality of plate segments each of which has a working surface including a plurality of bars being curved with said shape of a logarithmic type spiral.

5. The refining cone of claim 1 wherein the angle (α) is within the range of between +90 and −90 degrees.

6. A plate segment for a cone of a rotary conical refiner, comprising a working surface including a plurality of bars having inner and outer ends, laterally spaced by intervening grooves, said plurality of bars being curved with the shape of a logarithmic type spiral from the inner to the outer ends of the bars, wherein the shape of said bars conforms within manufacturing tolerances to the mathematical expression in polar coordinates in an original x-y plane orthogonal to the cone axis:

$$r = a \cdot e^{k \cdot \Phi}$$

where $$k = \cot \alpha$$

and $$k = 0 \rightarrow \text{circle}$$

this curve projected onto the working surface has a shape change according to the following formulae:

$$\alpha := \operatorname{atan}\left(\frac{\tan\left(\alpha cone \cdot \frac{\pi}{180}\right)}{\sin\left(20 \cdot \frac{\pi}{180}\right)}\right) \cdot \frac{180}{\pi}$$

$$bw := \frac{bwcone}{\sqrt{\sin\left[(90 - \alpha cone) \cdot \frac{\pi}{180}\right]^2 + \frac{\cos\left[(90 - \alpha cone) \cdot \frac{\pi}{180}\right]^2}{\sin\left(20 \cdot \frac{\pi}{180}\right)^2}}}$$

$$gw1 := \frac{gw1cone}{\sqrt{\sin\left[(90 - \alpha cone) \cdot \frac{\pi}{180}\right]^2 + \frac{\cos\left[(90 - \alpha cone) \cdot \frac{\pi}{180}\right]^2}{\sin\left(20 \cdot \frac{\pi}{180}\right)^2}}}$$

where "r" is the radial position along the centerline of the bar, "a" is a scale parameter for r and αis the intersecting angle between any tangent to the curve and the generatrix of the coordinate system, Gwl cone and bwcone are bar and groove width on the cone, gw and bw the bars and grooves width in the original x-y plane, the angle atone denominates the angle of the logarithmic type spiral curve on the working surface between a tangent to the curve and the generatrix of the cone, and, a is the angle of the logarithmic spiral in the x-y-plane.

7. The plate segment of claim 6, wherein the segment has a longer, outer edge and a shorter, inner edge, the working surface has a pattern of bars and grooves arranged in a first zone situated closer to the inner edge and a second zone situated closer to the outer edge, and essentially all the bars in the second zone are curved with said shape of a logarithmic type spiral.

* * * * *

UNITED STATES PATENT AND TRADEMARK OFFICE

CERTIFICATE OF CORRECTION

PATENT NO. : 7,398,938 B2
APPLICATION NO. : 11/330561
DATED : July 15, 2008
INVENTOR(S) : Antensteiner It is certified that error appears in the above-identified patent and that said Letters Patent is hereby corrected as shown below:

Column 9:

Line 26 claim 1, delete “acone” and substitute --αcone--.

Line 28 claim 1, after “and,” delete “a” and substitute --α--.

Column 10:

Line 37 claim 6, delete “atone” and substitute --αcone--.

Line 39 claim 6, after “and,” delete “a” and substitute --α--.

Signed and Sealed this

Fourth Day of November, 2008

JON W. DUDAS
*Director of the United States Patent and Trademark Office*